US006772440B1

(12) United States Patent
Foster

(10) Patent No.: US 6,772,440 B1
(45) Date of Patent: Aug. 10, 2004

(54) FISHING AND HUNTING WADER

(76) Inventor: Ronald W. Foster, 1750 Orchard Rd., Montgomery, IL (US) 60538

( * ) Notice: Subject to any disclaimer, the term of this patent is extended or adjusted under 35 U.S.C. 154(b) by 0 days.

(21) Appl. No.: 10/443,834

(22) Filed: May 23, 2003

(51) Int. Cl.[7] ..... A41B 11/00
(52) U.S. Cl. ..... 2/82
(58) Field of Search ..... 2/82, 81, 69, 79, 2/227, 243.1, 230, DIG. 1, DIG. 5

(56) References Cited

U.S. PATENT DOCUMENTS

| | | | | |
|---|---|---|---|---|
| 278,947 A | | 6/1883 | Harden | |
| 547,785 A | | 10/1895 | Henley | |
| 1,045,674 A | | 11/1912 | Cahill | |
| 2,355,193 A | | 8/1944 | Walker | |
| 2,762,054 A | | 9/1956 | Smith | |
| 2,967,306 A | | 1/1961 | Fabanich | |
| 3,476,102 A | * | 11/1969 | Sarnoff | 126/204 |
| 3,793,646 A | | 2/1974 | Tempelhof | |
| 4,034,417 A | * | 7/1977 | Ellis | 2/81 |
| 4,117,609 A | | 10/1978 | Helt | |
| 4,261,060 A | | 4/1981 | Zawacki | |
| 4,327,447 A | * | 5/1982 | Carnaghi et al. | 2/247 |
| 4,670,913 A | * | 6/1987 | Morell et al. | 2/227 |
| 4,888,830 A | * | 12/1989 | Putnam | 2/327 |
| 5,081,718 A | * | 1/1992 | Carman et al. | 2/227 |
| 5,269,023 A | * | 12/1993 | Ross | 2/66 |
| 5,711,031 A | | 1/1998 | Clement | |
| 5,826,273 A | * | 10/1998 | Eckes | 2/69 |
| 5,867,828 A | | 2/1999 | Shih | |
| 5,920,902 A | | 7/1999 | Crampton | |

FOREIGN PATENT DOCUMENTS

JP 2000-96303 * 4/2000 ..... A41B/9/02

* cited by examiner

*Primary Examiner*—Gary L. Welch
(74) *Attorney, Agent, or Firm*—Jacobson Holman PLLC

(57) ABSTRACT

A chest wader having advantageous features with respect to securing the wader to an individual, increased flexibility for movement without straining the seams of the wader, hand warming capabilities and pocket draining elements.

17 Claims, 6 Drawing Sheets

FISHING AND HUNTING WADER

FIELD OF THE INVENTION

The present invention relates to a chest wader having advantageous features with respect to securing the wader to an individual, increased flexibility for movement without straining the seams of the wader, hand warming capabilities and pocket draining elements.

BACKGROUND OF THE INVENTION

Waders are a critical piece of equipment for anglers or hunters who spend lots of time either fishing or hunting in cold rivers, fishing or hunting in colder weather or wading in shallow lakes or ponds that have colder water. The waders keep the angler dry and also keep the angler warm.

Waders are made of many different materials such as neoprene, breathable fabric, coated nylon, and rubber or a combination of rubber and canvas waders are available in different thicknesses, and different styles such as hip-high, waist-high and chest-high.

Breathable waders include fabric that allows perspiration to escape, while preventing water from entering. GORE-TEX fabric is an example of one of the materials that allow perspiration to escape. Some waders tend to be less flexible and heavier than other type waders making them cumbersome to maneuver and adding stress to their seams.

SUMMARY OF THE INVENTION

It is therefore an object of the present invention to provide a chest wader having advantageous features with respect to securing the wader to an individual, increased flexibility for movement without straining the seams of the wader, hand warming capabilities and pocket draining elements.

These objects are accomplished by a wader made of a material having a double suspender system for securing the wader to an individual. A double shoulder strap/double buckle arrangement is used, with one buckle on either side of the front of the wader. The shoulder straps include adjustable belts connected to one part of a two buckle part system. The second part of the two buckle part system is secured to the wader. Once the buckle on the shoulder strap is secured within the buckle on the wader, the adjustable belts are shifted to adjust the height of the front of the wader based upon an individual's size.

To ensure a secure connection of the shoulder straps to the body of the wader, a second connection for each shoulder strap is provided. This would overcome prior problems with the bib portion of the chest wader when loaded down with shotgun shells or other ammunition which would tend to force a single suspender system to disengage due to the weight hanging on the front of the wader.

This second connection includes a two part hook and loop fastener, made of VELCRO, for example, with one part being positioned on an exterior surface of each of the two shoulder straps. Lining the interior of the wader, extending from an upper front edge downward into the interior of the wader, is the second part of the hook and loop fastener. By pressing the exterior surface of each shoulder strap against the interior surface of the wader, the hook and loop fastener portions are interengaged to securely holder the shoulder straps in position as assisted by the interconnection of the two part buckle system for each shoulder strap. This dual suspender system secures the shoulder straps in place.

Another feature of the present invention is a hands through-pocket defined on the front of the bib of the wader.

This pocket, similar to a through-pocket located on the front of a hooded sweatshirt, may be used by the individual wearing the wader to rub their hands together in a protected area so to generate and retain heat.

In the present invention, positioned in this through-pocket is a resealable container for housing a replaceable chemical heat pouch. The chemical heat pouch, once activated, is placed in the resealable container which is located in the through-pocket of the wader.

The individual may then place their hands behind, in front or around the container having the chemical heat pouch for extended periods of time, depending upon the particular type of chemical heat pouch used. Typically, the chemical heat pouch may last three to five hours in providing a constant source of heat. This would be ideal for a typical fishing or hunting excursion and provide support for an extended length of stay.

Another feature of the present invention is the inclusion in two side pockets and in a central bib pocket of at least three aligned through holes which allow easy escape of any captured water. Oftentimes, when leaving a stream, water is retained in any pockets included with the wader. The water retained in these pockets is difficult to empty in that the wader must be either removed or the individual must go through contortions so as to attempt to remove the water from the pockets.

By the present invention, water easily escapes from external pockets by holes intentionally made near the bottom of these pockets. Gravity forces the water through the at least three holes in each of the external pockets.

Traditionally, the seams of a wader converge at a single point in the crotch area of the wader. This would include the leg seams on the inside of the legs an well as a center seam of the front and rear portions of the wader. Large amount of stress forces are imparted on this single point of conversion of seams when the individual wearing a wader squats, splits or lifts up their legs as is normally encountered in wading.

Alternatively, prior waders have included a diamond shaped insert at the junction of the upper part of the legs and the front and rear of the wader. This diamond shaped section typically extends for approximately 8inches in length and 12 inches in width. Great stress is applied along its multiple seams during movement of the wader.

In an effort to distribute these stress forces across a wider area, the wader of the present invention includes an approximately two inch wide single rectangular strip which extends up from each boot and continues along the interior of the legs between both boots. The seams are positioned at the front and rear of each leg so as to move the point of stress on the seams away from the crotch area. This positioning avoids the stress factors previously encountered in waders.

Accordingly, it is another object of the present invention to provide a wader having a dual connection/dual suspender system for ensuring secure attachment of the wader on an individual.

It is another object of the present invention to provide a pass through pocket on the front of a bib of a wader having a container for holding a chemical warming material which would pass heat to the hands of a user when the hands are inserted in the pass through pocket.

It is still yet another object of the present invention to have a series of external pockets on a wader with through holes at the bottom of each pocket for releasing water that may be entrapped in the pocket when the wader is removed from the water.

It is still yet another object of the present invention to provide a wader having an elongated rectangular strip extending along the two leg portions between each of the boots so as to minimize the stress levels encountered in the crotch area of the wader during movement of the wader.

It is still yet another object of the present invention to provide a wader having a dual connection/dual suspender system for ensuring secure attachment of the wader on an individual, a pass through pocket on the front of a bib of a wader having a container for holding a chemical warming material which would pass heat to the hands of a user when the hands are inserted in the pass through pocket, to have a series of external pockets on a wader with through holes at the bottom of each pocket for releasing water that may be entrapped in the pocket when the wader is removed from the water and a wader having an elongated rectangular strip extending along the two leg portions between each of the boots so as to minimize the stress levels encountered in the crotch area of the wader during movement of the wader.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
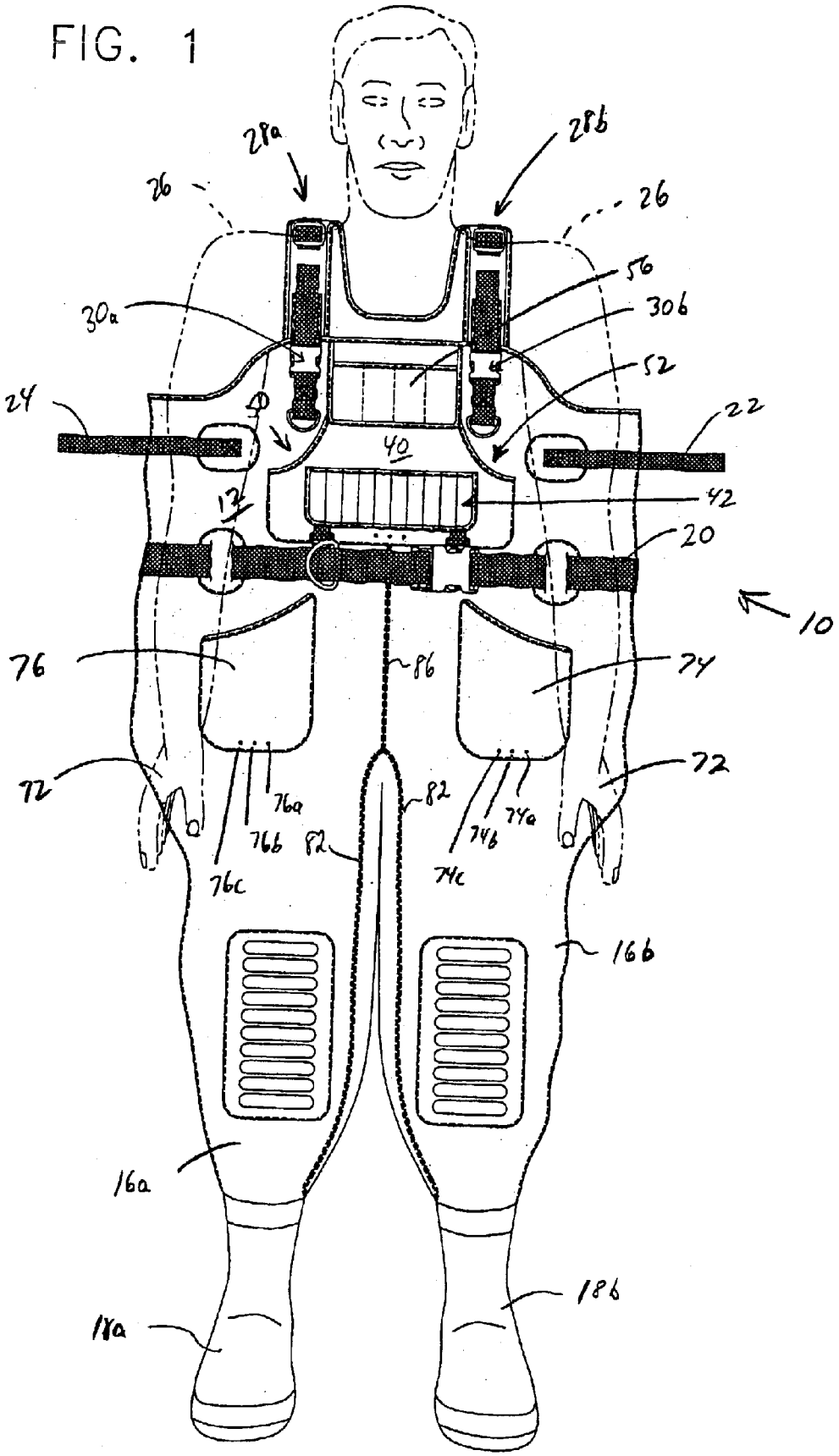
FIG. 1 is a front view of a wader according to the present invention shown secured onto an individual.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIG. 1, in particular, a multi-featured wader embodying the principles of the present invention is generally designated as 10. The wader includes a front portion 12, a rear portion 14 and two leg portions 16*a*, 16*b*. At the bottom of the leg portions are secured wading boots 18*a*, 18*b*, respectively. The wading boots 18*a*, 18*b* are an integral part of the wader 10.

In an upper portion of the wader, a fastening belt 20 encircles a waist portion of the wader for securing the wader around the waist of an individual. Two side straps 22, 24 are also used to adjust the wader so as to grab the sides of an individual.

Two shoulder strap assemblies 28*a*, 28*b* secure the wader around the shoulders 26 of an individual. Each of the shoulder strap assemblies 28*a*, 28*b* includes a two part buckle 30*a*, 30*b* with the parts 32 and 34 of buckle assembly 30*a* shown in FIG. 2 and the additional parts 36, 38 of buckle assemble 30*b* shown in FIG. 3. The buckle parts 32 and 34 are controlled by straps 32*a* and 34*a* to adjust the position of the respective buckle parts 32, 34, parts 36, 38. The straps 32*a*, 34*a* and 36*a*, adjust the length of the shoulder strap assemblies 28*a*, 28*b* according to the height of the individual. Similarly, straps 36*a* and 38*a* control the location of the buckle parts 36, 38. The straps 32*a*, 34*a* and 36*a*, 36*b* adjust the length of the shoulder strap assemblies 28*a*, 28*b* according to the height of the individual.

As generally shown in FIG. 1, the front 12 of the wader includes a bib portion 40 which includes a pouch 42 separated into a plurality of shotgun shell holding sections. Alternatively, pouch 42 may be designed to hold clips of ammunition or individual bullets. The weight of shotgun shells, ammunition clips and/or bullets, is significant and adds stress to the interconnection of the two part buckle assemblies 32, 34 and 36, 38.

Figure 3:
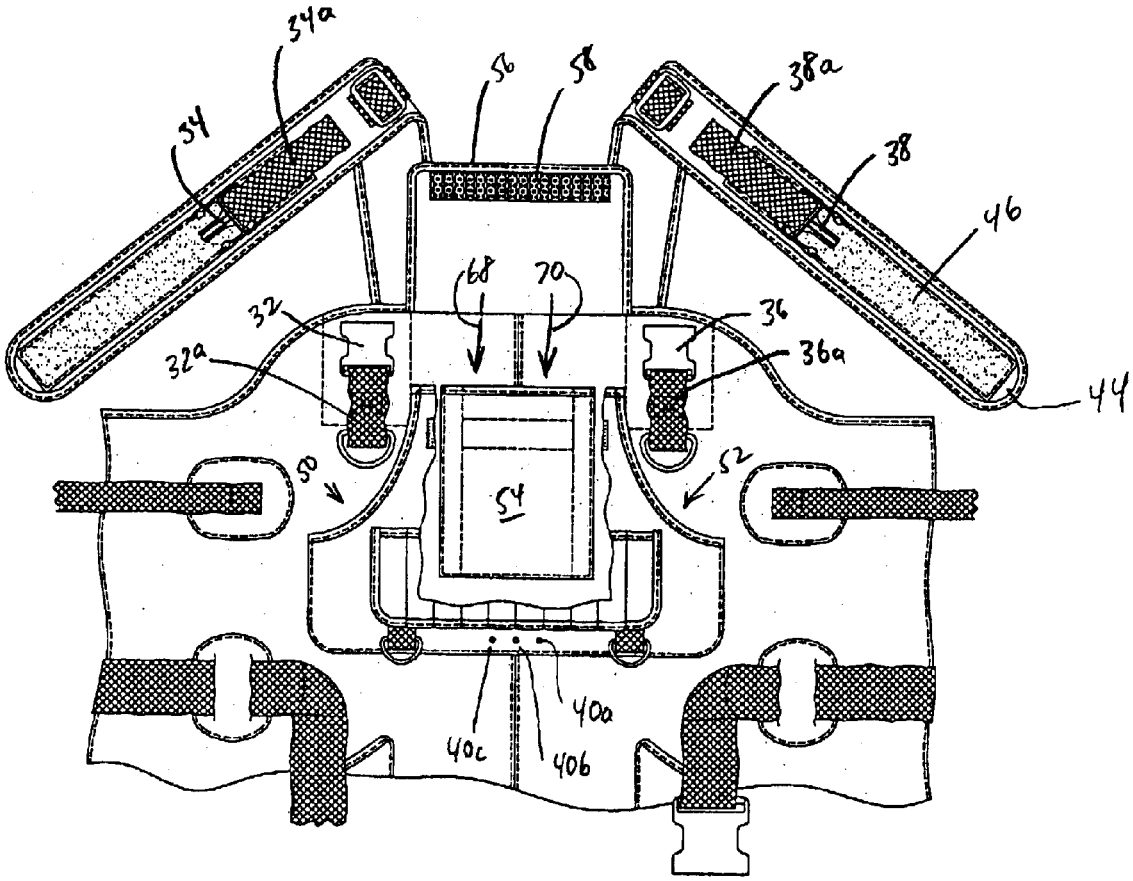
FIG. 3 illustrates a partial front view of the bib portion of the wader with both shoulder straps detached and a cut away view of the interior of the pass through pocket.
Figure 5:
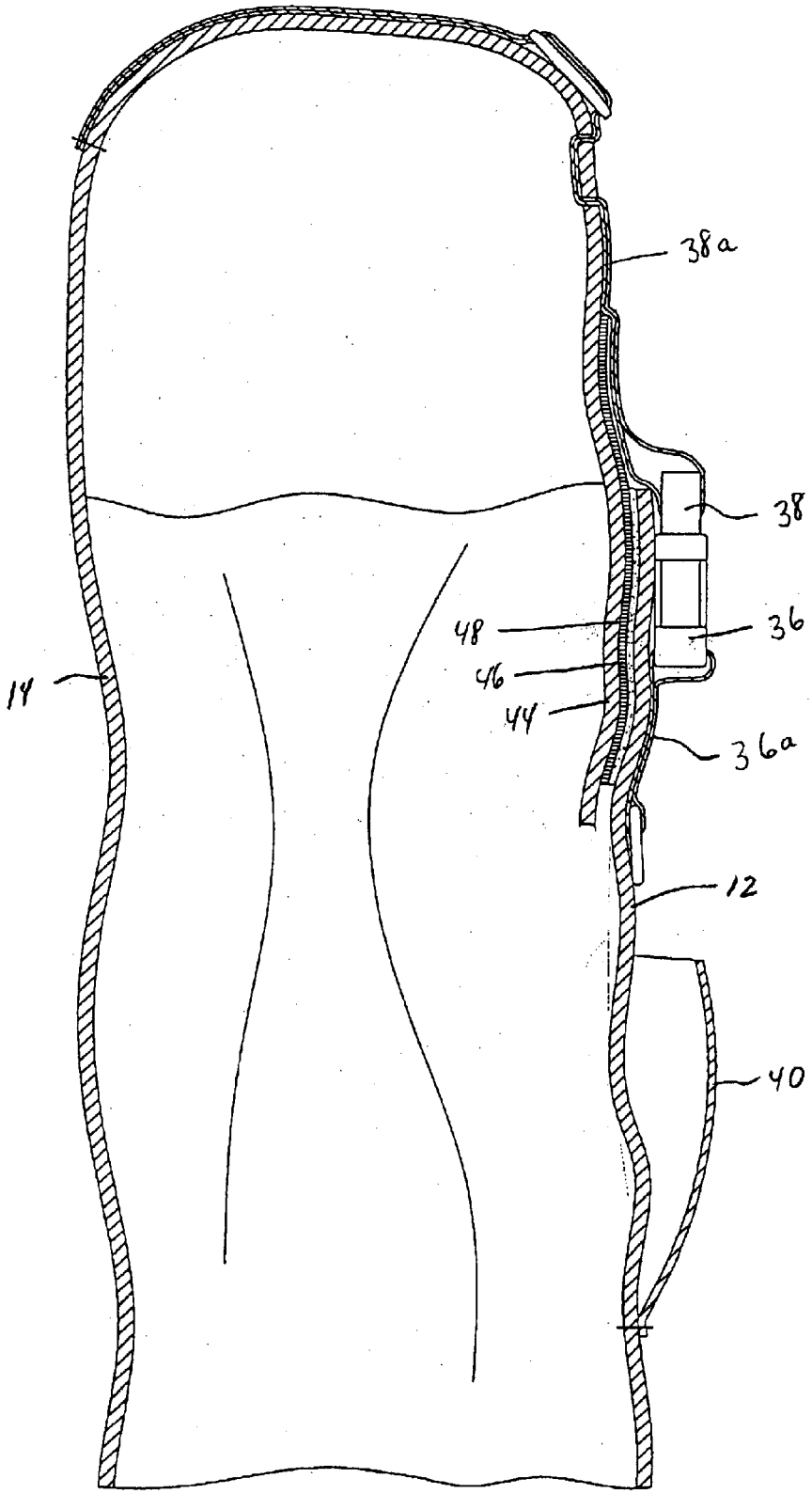
FIG. 5 is a sectional view taken along line 5—5 of FIG. 2.
Figure 6:
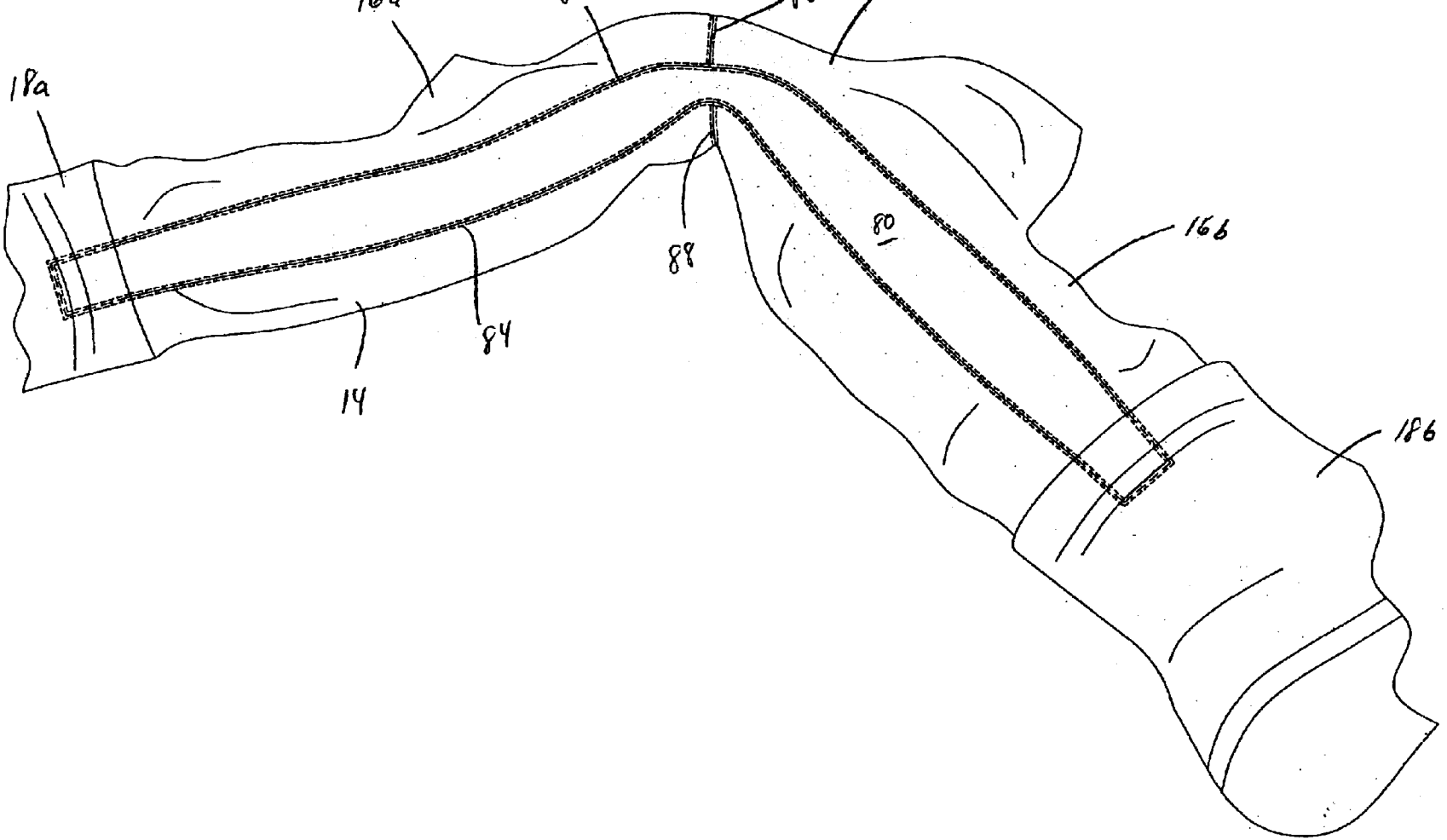
FIG. 6 is a bottom perspective view of the leg portions of the wader.

To ensure against the separation of the buckle parts 32, 34 and 36, 38, the shoulder strap assemblies 28*a*, 28*b* include a second system for securing the shoulder strap assemblies 28*a*, 28*b* in place. As shown in FIGS. 3 and 5, the strap 44 includes an exterior surface having one part 46 of a hook and loop fastener secured thereto. On the interior of the front section 12 of the wader is located the other part 48 of the hook and loop fastener. As best shown in FIG. 5, the strap 44 is secondarily held in place by the hook and loop fastener so as to avoid the forces exerted on pouch 42 due to the weight of shotgun shells, clips of ammunition and/or ammunition.

Another advantageous feature of the present invention is provided by the use of the hand warming openings 50, 52 of the bib 40. Once the hands of the individual are placed through these openings, the hands are able to engage a container 54 as shown in FIGS. 2 and 4.

Figure 2:
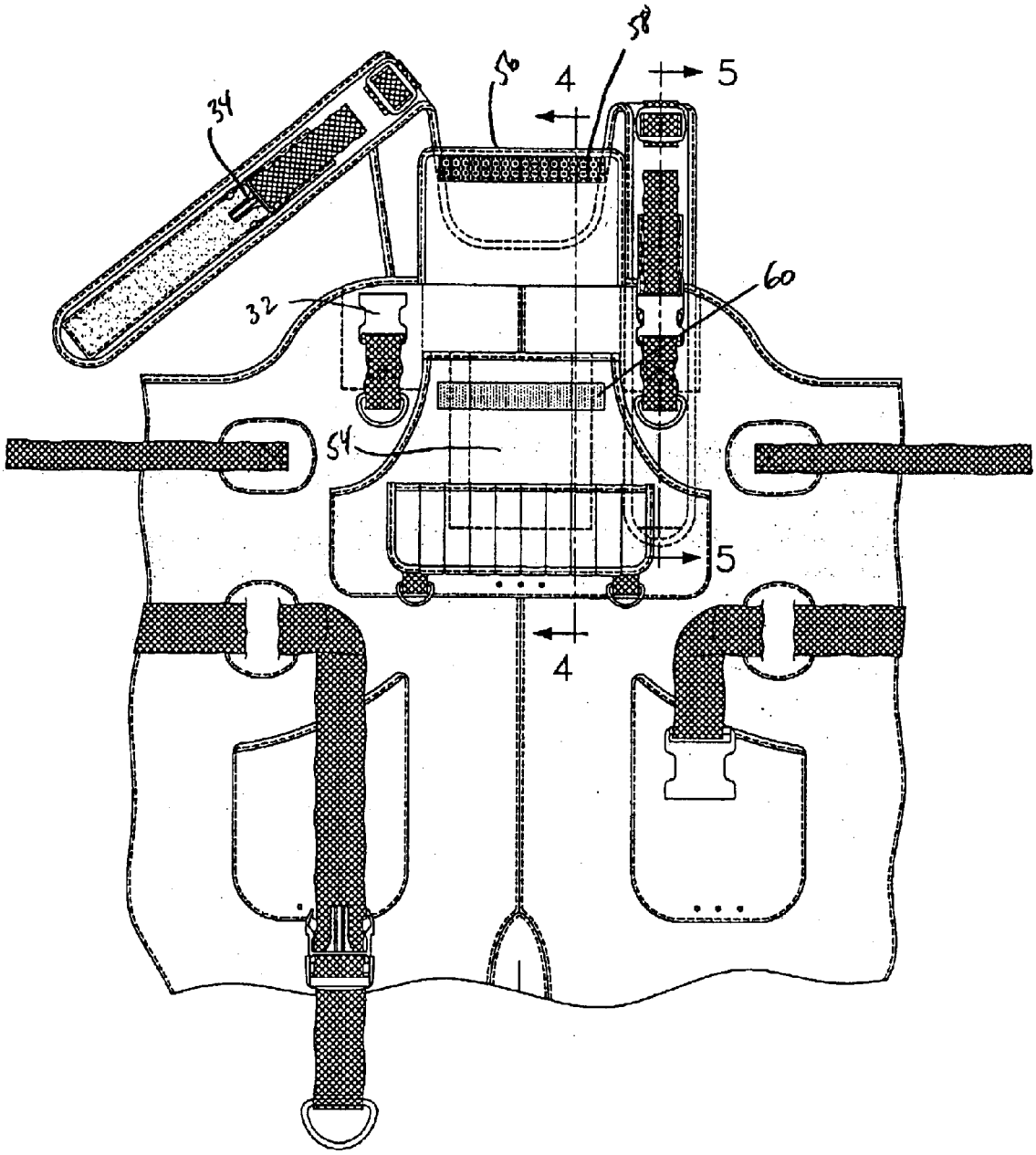
FIG. 2 is a partial front view of the bib portion of a wader with one of the shoulder straps detached and a cover over the pass through pocket being raised so as to gain access from an upper portion of the pass through pocket.

By lifting flap 56 as shown in FIGS. 2 and 3 and by separation of hook and loop fastener parts 58, 60, access is gained to the container 54 which has a two part hook and loop fastener 62, 64 to secure the top of the container 54. A chemical heat pouch 66 is activated so as to retain heat within the container 54. The pouch 66 is inserted into the container 54 in the direction of arrows 68, 70.

Figure 4:
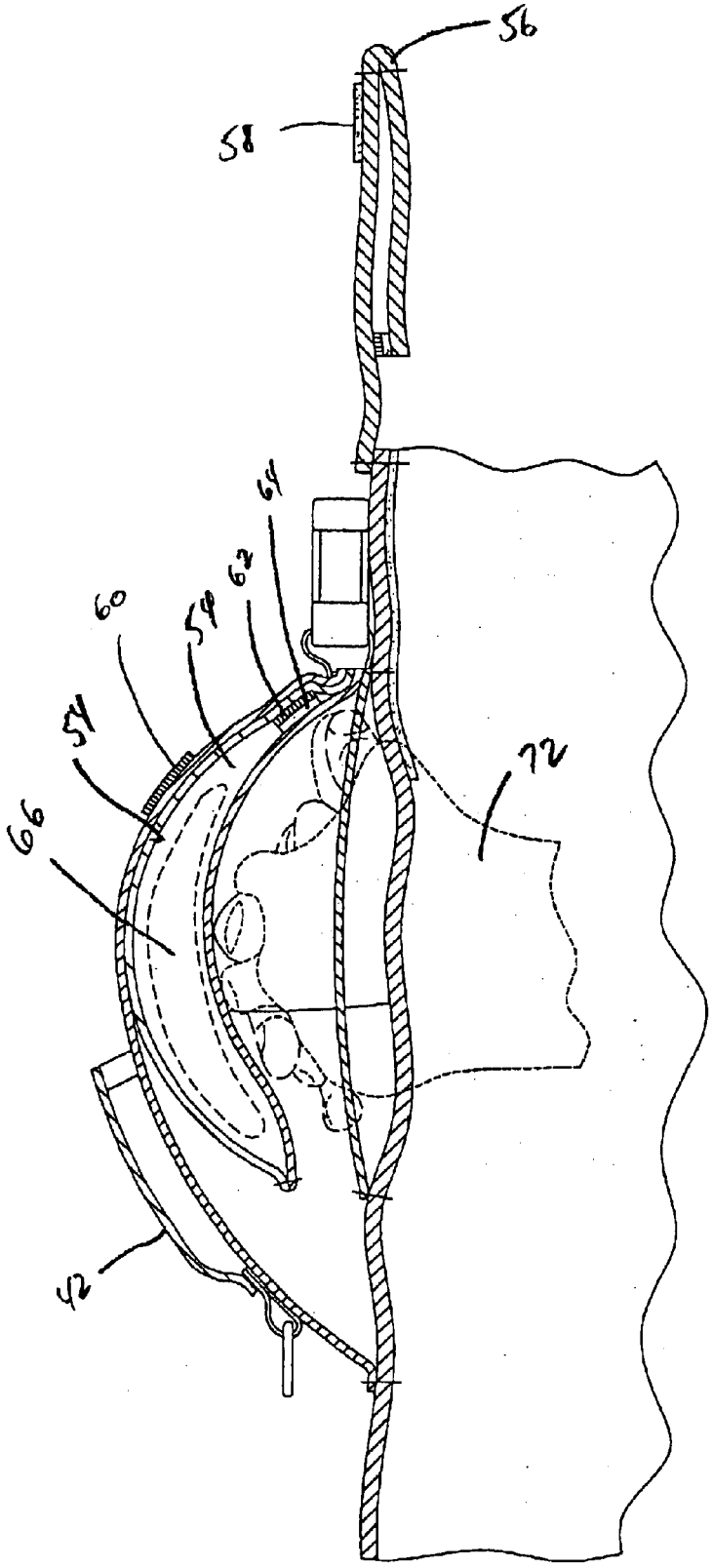
FIG. 4 is a sectional view taken along line 4—4 of FIG. 2.

Then, as shown in FIG. 4, the hands 72 of the individual are placed through the openings 50, 52 so as to be located adjacent to the container 54. The heat from pouch 66 radiates towards the hands 72. Once the heat from pouch 66 is dissipated, another chemical heat pouch may be placed into container 54.

Again with reference to FIG. 1, in addition to the bib 40, two side pockets 74, 76 are located on the front 12 of the wader. Each of the side pockets 74, 76 and the bib 40 include sets of holes 74*a*, 74*b*, 74*c*, 76*a*, 76*b*, 76*c* and 40*a*, 40*b*, 40*c*, respectively. These sets of holes allow any water trapped in the pockets 74, 76 and/or bib 40 to escape when the wader is removed from water. These sets of holes do not affect the insulating properties of the wader in that pockets 74, 76 and bib 40 are external to the panels making up the wader 10.

Another object of the present invention is the incorporation of approximately a two inch wide strip 80 which extends from boot 18a along leg 16*a*, down leg 16*b* and into boot 18*b*. The strip 80 is made of the same stretchable material as the rest of the wader. The strip 80 extends into each of boots 18*a* and 18*b* for approximately two inches.

The rectangular shaped strip is secured to legs 16*a*, 16*b* by seam 82 at front portion 12 of the wader. Similarly, seam 84 interconnects the legs 16*a*, 16*b* with the strip 80 at the rear portion 14 of the wader. A central elongated seam 86 intersects the strip 80 at the front portion 12 of the wader. Similarly, a seam 88 extending along the rear portion 14 intersects the strip 80.

By offsetting all seam stress points away from a concentrated central point or central section of the wader located in the crotch area, the stresses on the seams 82, 84, 86 and 88 are minimized. This prolongs the life of the wader by transferring stress forces to the elongated rectangular strip 80 formed of a stretchable material, and away from traditional concentrated seam areas.

One or more of the various advantageous features of the present invention may be incorporated into a wader for beneficial results. These features provide benefit individually as well as collectively to produce an improved wader.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A wader comprising;

a front portion;

a rear portion; and two shoulder strap assemblies interconnecting the front portion and the rear portion, each of said two shoulder strap assemblies including a shoulder strap, a two part connector connecting said shoulder strap with said front portion, and a hook and loop fastener connecting said shoulder strap with said front portion, one part of said hook and loop fastener being located on said shoulder strap and the other part of said hook and loop fastener being located on an interior surface of said front portion.

2. The wader as claimed in claim 1, further comprising two leg portions made from part of the front portion and the rear portion with an elongated single section extending along an interior of each of the two leg portions and the elongated single section is connected to the front portion and the rear portion along two seams.

3. The wader as claimed in claim 2, wherein the elongated single section is rectangular.

4. The wader as claimed in claim 3, wherein a width of said elongated single section is two inches wide.

5. The wader as claimed in claim 1, further comprising at least one external pocket having at least one self-draining hole for removal of water from the at least one external pocket when the wader is removed from water.

6. The wader as claimed in claim 1, further comprising an external pocket having a container for holding a chemical warming pouch so as to warm at least one hand of an individual wearing the wader.

7. A wader comprising:

a front portion;

a rear portion; and two shoulder strap assemblies interconnecting the front portion and the rear portion, each of said two shoulder strap assemblies including a shoulder strap, a two part connector connecting said shoulder strap with said front portion, and a hook and loop fastener connecting said shoulder strap with said front portion, said two part connector being a two part buckle, one part of said two part buckle being located on said shoulder strap and the other part of said two part buckle being located on an exterior surface of said front portion.

8. The wader as claimed in claim 7, wherein one part of said hook and loop fastener is located on said shoulder strap and the other part of said hook and loop fastener is located on an interior surface of said front portion.

9. The wader as claimed in claim 8, wherein said two part buckle includes an adjusting strap for adjusting a length of interconnection of the shoulder strap and the front portion.

10. A wader comprising:

a front portion;

a rear portion;

two leg portions each terminating in a boot; and an elongated single section extending along an interior of each of said two leg portions from the boot of one leg portion to the boot of the other leg portion and being connected to said front portion and said rear portion by two elongated seams, the elongated single section being rectangular and extending at least adjacent to the boot of both of the two leg portions.

11. The wader as claimed in claim 10, further comprising at least one external pocket having at least one self-draining hole for removal of water from the at least one external pocket when the wader is removed from water.

12. The wader as claimed in claim 11, further comprising an external pocket having a container for holding a chemical warming pouch so as to warm at least one hand of an individual wearing the wader.

13. A wader comprising:

a front portion;

a rear portion connected to the front portion to form a garment extending up to at least the chest of the wearer;

an external pocket located at a chest portion of the garment and having an entranceway for at least one hand of an individual wearing the wader;

a container included in the external pocket for holding a chemical warming pouch so as to warm the at least one hand of the individual wearing the wader and inserted in the external pocket, the container being resealable for receiving and removing the chemical warming pouch; and a resealable flap hanging from an upper edge of the front portion of the garment for covering an entranceway to the container and being securable to the front portion of the garment at the chest portion of the garment.

14. The wader as claimed in claim 13, wherein the pocket has at least one self-draining hole for removal of water from the at least one external pocket when the wader is removed from water.

15. The wader as claimed in claim 13, further comprising two leg portions made from part of the front portion and the rear portion with an elongated single section extending along an interior of each of the two leg portions and the elongated single section is connected to the front portion and the rear portion along two elongated seams.

16. The wader as claimed in claim 15, wherein the elongated single section is rectangular.

17. The wader as claimed in claim 16, wherein a width of said elongated single section is two inches wide.

* * * * *